US012679517B2

(12) United States Patent
Grall et al.

(10) Patent No.: US 12,679,517 B2
(45) Date of Patent: Jul. 14, 2026

(54) SYSTEM FOR RECOVERING AUTONOMOUS UNDERWATER OR SURFACE WATER VEHICLES

(71) Applicant: IXBLUE, Saint-Germain-en-Laye (FR)

(72) Inventors: Sébastien Grall, Saint-Germain-en-Laye (FR); Lionel Secco, Saint-Germain-en-Laye (FR)

(73) Assignee: EXAIL, Saint-Germain-en-Laye (FR)

( * ) Notice: Subject to any disclaimer, the term of this patent is extended or adjusted under 35 U.S.C. 154(b) by 755 days.

(21) Appl. No.: 17/922,331

(22) PCT Filed: Apr. 26, 2021

(86) PCT No.: PCT/EP2021/060874

§ 371 (c)(1),
(2) Date: Oct. 28, 2022

(87) PCT Pub. No.: WO2021/219573

PCT Pub. Date: Nov. 4, 2021

(65) Prior Publication Data

US 2023/0174204 A1 Jun. 8, 2023

(30) Foreign Application Priority Data

Apr. 28, 2020 (FR) ..... 2004202

(51) Int. Cl.
*B63G 8/00* (2006.01)
*B63C 7/02* (2006.01)
*B63C 7/16* (2006.01)

(52) U.S. Cl.
CPC ..... *B63C 7/16* (2013.01); *B63C 7/02* (2013.01); *B63G 8/001* (2013.01); *B63G 2008/004* (2013.01)

(58) Field of Classification Search
CPC .... B63C 7/02; B63C 7/16; B63C 7/20; B63G 2008/002; B63G 2008/005; B63G 2008/007; B63G 2008/008
See application file for complete search history.

(56) References Cited

U.S. PATENT DOCUMENTS 7,798,086 B2 * 9/2010 Ruggaber ..... B63C 7/16 114/316
8,424,479 B1 4/2013 Caccamo
(Continued)

FOREIGN PATENT DOCUMENTS

CN 205310278 U * 6/2016
CN 116620484 A * 8/2023 ..... B63B 27/16
(Continued)

OTHER PUBLICATIONS

International Search Report for PCT/EP2021/060874 dated Jul. 22, 2021, 7 pages with English Translation.
(Continued)

*Primary Examiner* — Kayla Mccaffrey
(74) *Attorney, Agent, or Firm* — NIXON & VANDERHYE

(57) ABSTRACT

A system for recovering, in a support and storage structure, an autonomous aquatic vehicle. The structure includes an access opening through which the autonomous vehicle can pass to enter into a housing of the structure or leave the housing in a main access direction. At least one drive member of the autonomous vehicle is arranged in the access opening, the drive member including at least one movable motorized drive element, which can be engaged with the shell of the autonomous vehicle and which enables the autonomous vehicle to be driven into or out of the structure.

19 Claims, 5 Drawing Sheets

(56) References Cited

U.S. PATENT DOCUMENTS

| | | | | |
|---|---|---|---|---|
| 9,522,715 | B1 | 12/2016 | Gerard | |
| 10,046,463 | B1 * | 8/2018 | Jones | B63G 8/001 |
| 10,351,212 | B2 * | 7/2019 | Jourdan | B63G 8/001 |
| 11,377,183 | B2 * | 7/2022 | Du | B63G 8/001 |
| 11,414,163 | B2 * | 8/2022 | Cadalen | B63C 7/20 |
| 11,485,461 | B2 * | 11/2022 | Latham | B63C 7/24 |
| 11,845,521 | B2 * | 12/2023 | Santana Lima | B63B 21/20 |
| 2005/0204991 | A1 | 9/2005 | Robichaud et al. | |
| 2008/0202405 | A1 | 8/2008 | Kern | |
| 2010/0018449 | A1 * | 1/2010 | Luccioni | B63B 27/36 114/322 |

FOREIGN PATENT DOCUMENTS

| | | |
|---|---|---|
| DE | 10 2017 220 932 | 5/2019 |
| FR | 2823485 B1 * | 8/2003 |
| WO | 2004/103804 | 12/2004 |

OTHER PUBLICATIONS

Written Opinion of the ISA for PCT/EP2021/060874 dated Jul. 22, 2021, 11 pages with English Translation.

* cited by examiner

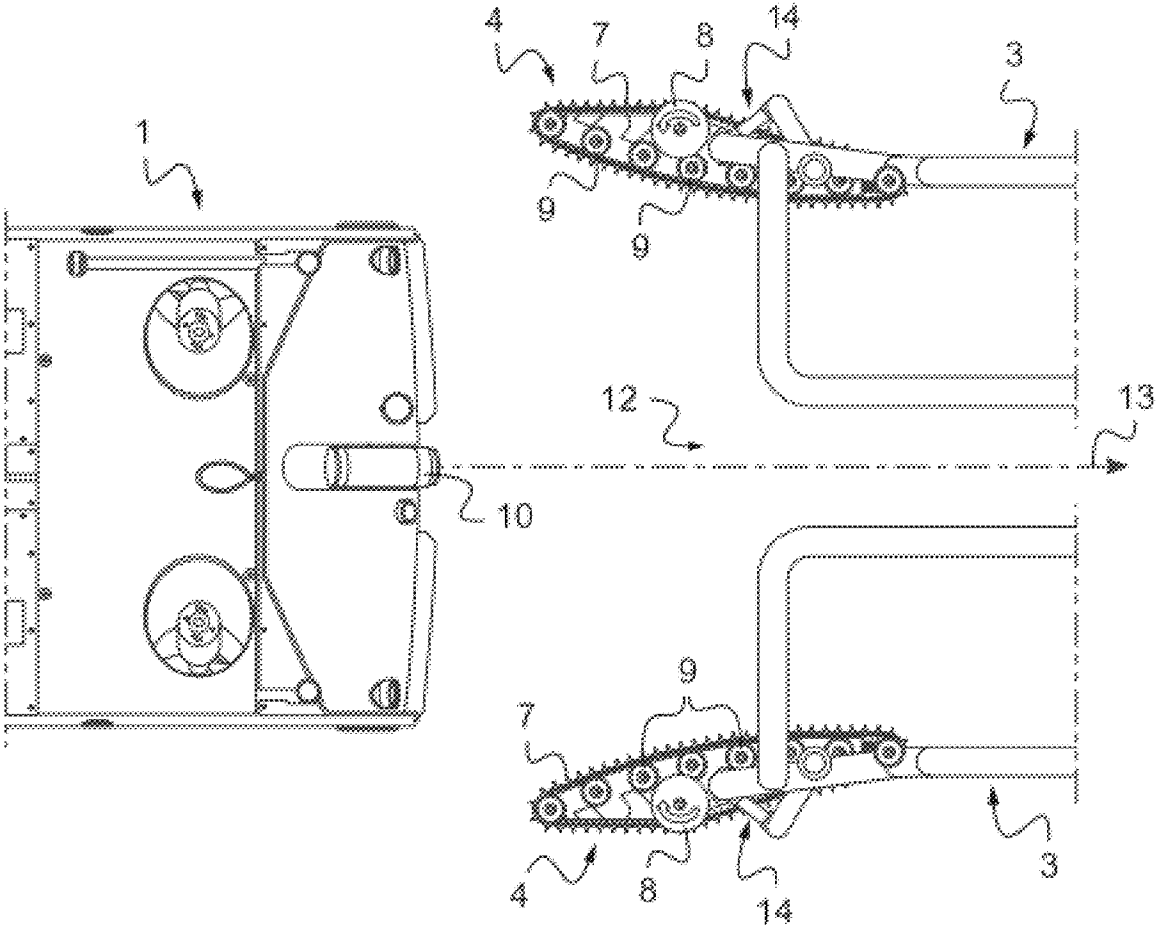
[Fig. 1]

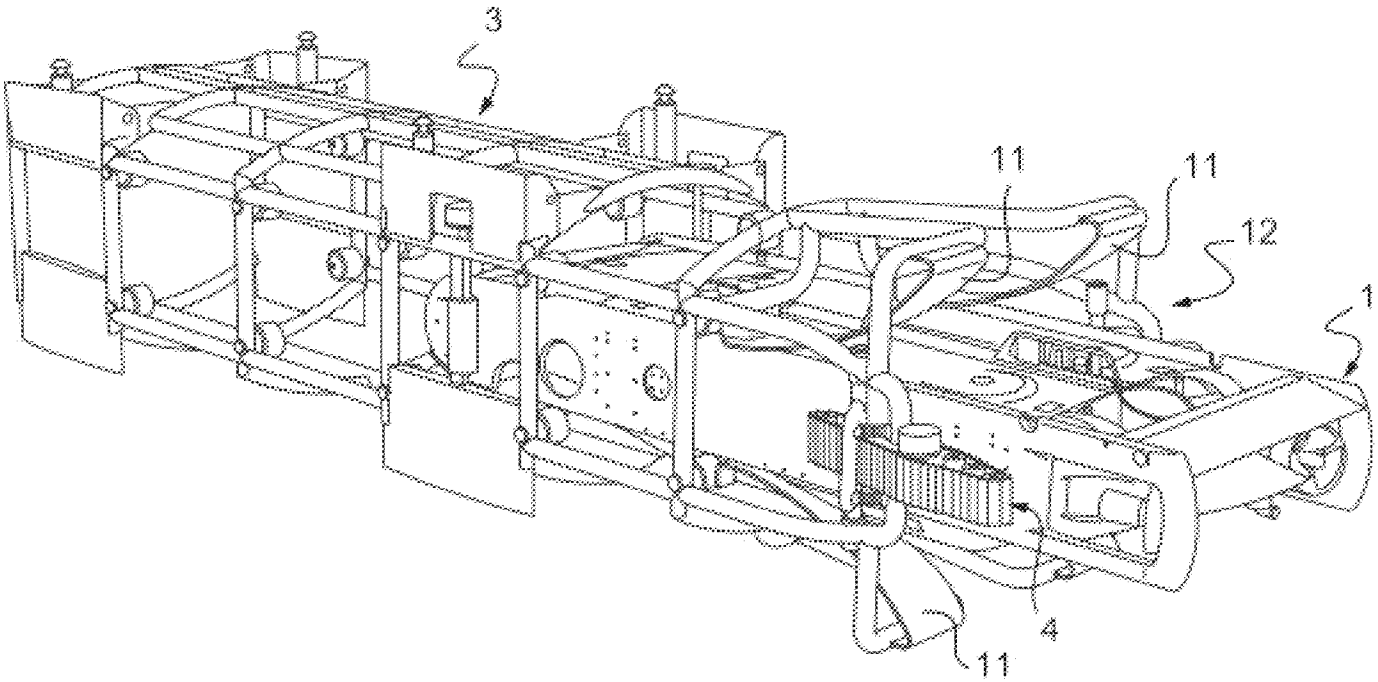
[Fig. 2]

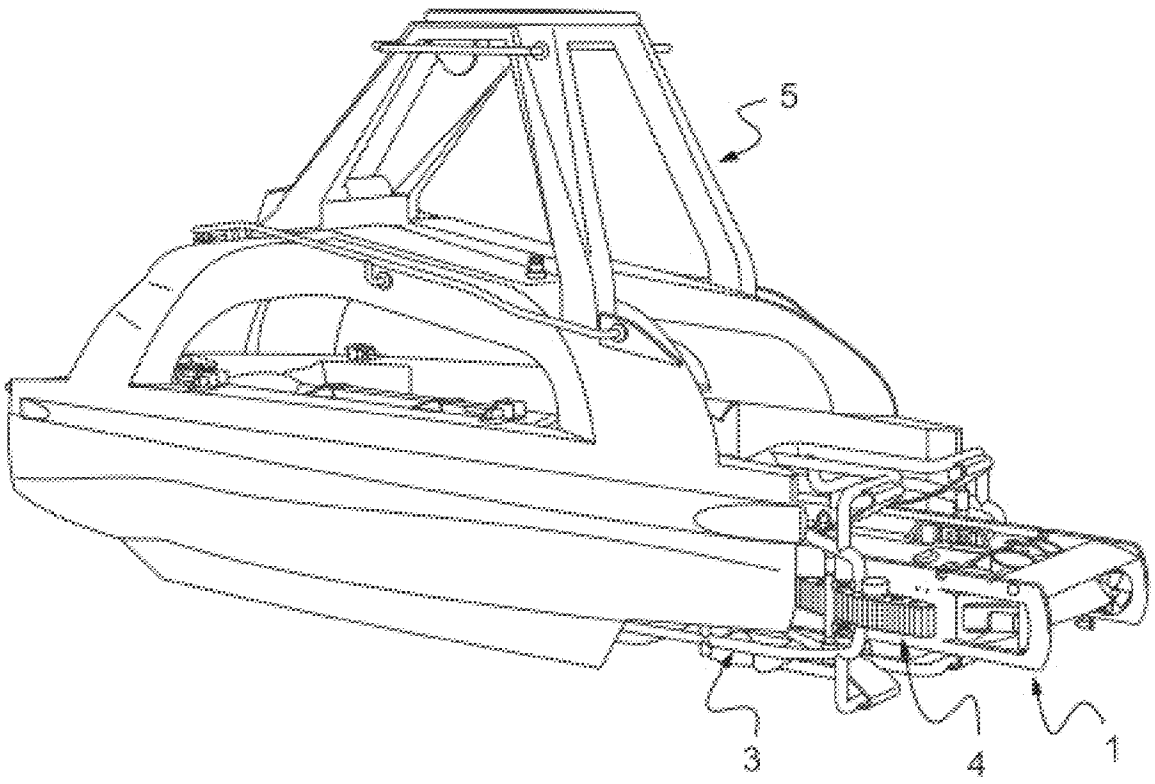
[Fig. 3]

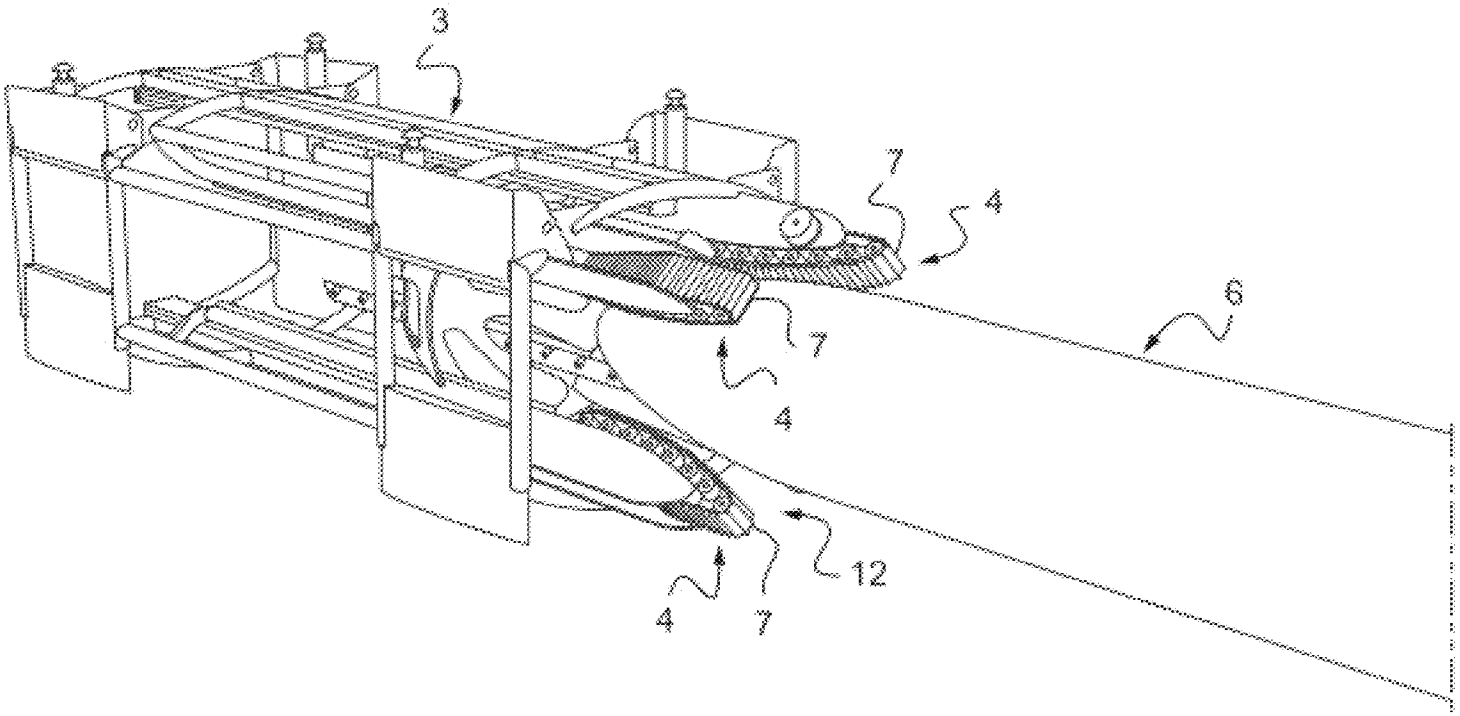
[Fig. 4]

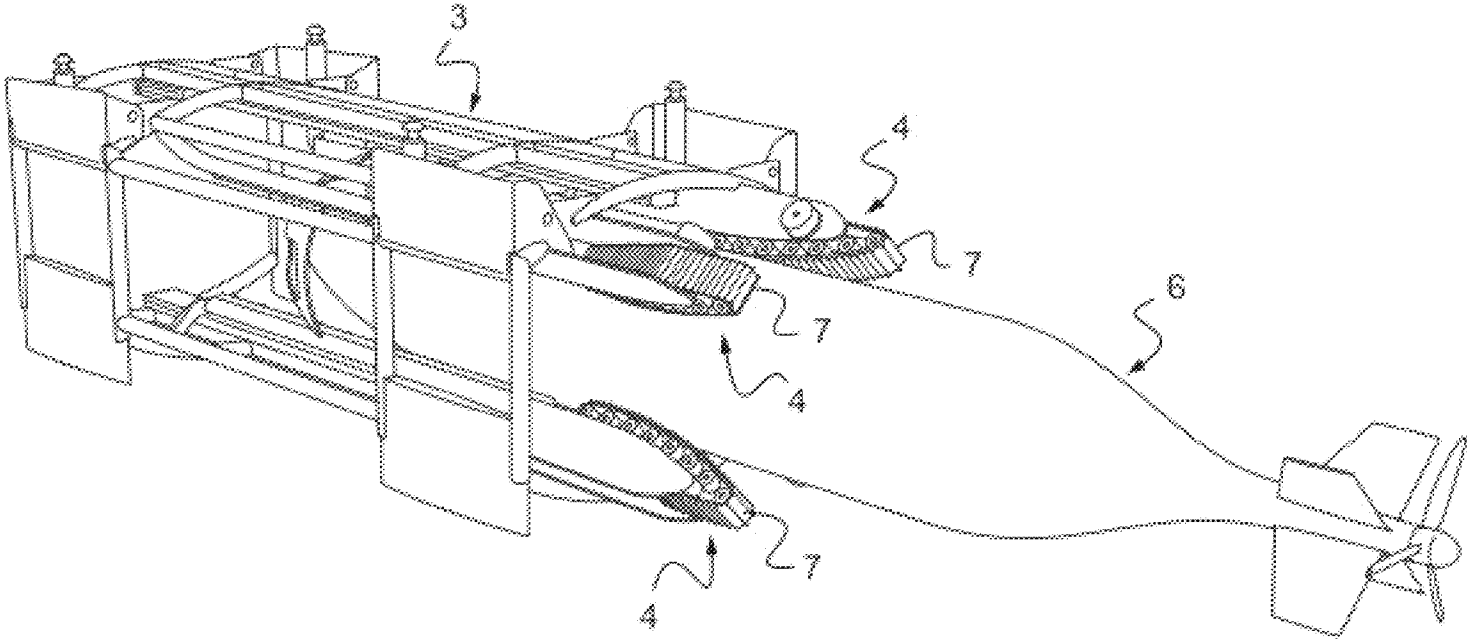
[Fig. 5]

SYSTEM FOR RECOVERING AUTONOMOUS UNDERWATER OR SURFACE WATER VEHICLES

Cross-Reference to Related Applications

This application is the U.S. national phase of International Application No. PCT/EP2021/060874 filed Apr. 26, 2021 which designated the U.S. and claims priority to FR Patent Application No. 2004202 filed Apr. 28, 2020, the entire contents of each of which are hereby incorporated by reference.

TECHNICAL FIELD

The present invention generally relates to the field of underwater and surface autonomous vehicles and more particularly relates to a system for recovering autonomous underwater vehicles (AUV) or surface vehicles (USV). It has applications in the field of shipbuilding.

TECHNOLOGICAL BACKGROUND

In the field of marine exploration equipment, autonomous marine or underwater exploration vehicles are implemented, which have to be recovered after exploration. These autonomous vehicles make it possible to carry out various measurements and surveys and comprise various measurement devices, including echosounders, sonars... In order to facilitate the recovery of the autonomous vehicle, an aquatic vehicle may be implemented, having an internal receiving and storage structure with an access opening through which the autonomous vehicle can pass to enter said receiving and storage structure or to exit therefrom. Therefore, the autonomous vehicle is recovered or released in the aquatic environment, the aquatic vehicle being easier to handle, in particular to be raised on board a ship. Therefore, the document FR17/60492 proposes a floating structure for the launching and the recovery of at least one autonomous aquatic vehicle by a ship. In this type of system, the autonomous vehicle has to enter the receiving and storage structure and exit therefrom on its own.

Recovery devices are also known by the following documents: US 2005/204991 A1 that discloses a retrieval device for an underwater vehicle with two drive tracks but without information about the functional positions of the tracks; US 2008/202405 A1; DE 10 2017 220932 A1; U.S. Pat. Nos. 8,424,479 B1; 9,522,715 B1 and WO 2004/103804 A1, these latter documents disclosing recovery devices for water vehicles, most of them with recovery ramps.

DISCLOSURE OF THE INVENTION

The applicant proposes, with the present invention, a solution for driving the autonomous vehicle to make it enter a receiving and storage structure or exit therefrom. In its principle, it consists of a cage-type AUV or USV recovery structure. This structure may be floating or submerged, active, i.e. equipped with propellers, or passive. This structure may be suspended or towed. This structure, whose geometry allows receiving and storing the autonomous vehicle, is equipped with a mechanism for causing active entrance of the vehicle as soon as the latter begins to engage the opening of the receiving and storage structure.

Therefore, this is not the vehicle that has to position, by its own propelling, in the receiving and storage structure, but the system that, thanks preferably to driven tracks, forces the vehicle to enter the receiving and storage structure or, conversely, to exit therefrom. These tracks are preferably positioned in such a way that the contact with the autonomous vehicle is ensured whatever the angle of arrival of the autonomous vehicle with respect to the main direction of access to the receiving and storage structure. Advantageously, the tracks are swivelling and spring-loaded in such a way that they provide the autonomous vehicle with a great freedom of movement at the beginning of the entry phase. The spring also allows absorbing the shocks between the autonomous vehicle and the recovery system.

More precisely, the invention relates to a system for recovering, in a receiving and storage structure, an autonomous vehicle in an aquatic environment, the autonomous vehicle having an external shell, the receiving and storage structure comprising an access opening through which the autonomous vehicle can pass to enter a housing of said receiving and storage structure or to exit therefrom along a main direction of access to the receiving and storage structure, wherein at least one drive member for the autonomous vehicle is arranged in the access opening, the drive member comprising at least one motorized movable drive element, which can come against the shell of the autonomous vehicle and which enables the autonomous vehicle to be driven into or out of the receiving and storage structure.

Other non-limiting and advantageous features of the method according to the invention, taken individually or according to all the technically possible combinations, are the following:

- the system comprises a receiving and storage structure including at least one drive member,
- the autonomous vehicle is an autonomous underwater vehicle (AUV) or an autonomous surface vehicle (USV),
- the receiving and storage structure forms a cage within an aquatic vehicle,
- the receiving and storage structure is removable in an aquatic vehicle,
- the aquatic vehicle is a floating vehicle,
- the aquatic vehicle is a floating vehicle able to be submerged,
- the aquatic vehicle is a submerged vehicle,
- the aquatic vehicle is a passive vehicle suspended or towed having to be dragged or hoisted for being moved,
- the aquatic vehicle is an active vehicle with propellers,
- the active aquatic vehicle may further be suspended or towed,
- the drive member ensures a centring of the autonomous vehicle,
- the receiving and storage structure includes means for centring the autonomous vehicle,
- the centring means are slides,
- the centring means are rolling rolls on which the autonomous vehicle shell can circulate,
- the rolling roll are passive,
- the rolling roll are motorized and ensure complementarily the driving of the autonomous vehicle,
- the motorized movable element is a track that is consisted of an elongated endless belt, extended between the internal and external ends of the drive member and able to be set in motion,
- the track is made of vulcanised rubber,
- the endless belt part of the track that comes opposite the autonomous vehicle shell between the internal and external ends of the drive member rests on a frame of the drive member through wheels mounted on resilient elements, in particular springs or shock absorbers, the endless belt part of the track that comes opposite the autonomous vehicle shell is substantially longitudinally flat between the internal and external ends of the drive member, in the absence of application against the shell, the endless belt part of the track that comes opposite the autonomous vehicle shell is longitudinally curved between the internal and external ends of the drive member, in the absence of application against the shell, the endless belt part of the track that comes opposite the autonomous vehicle shell is longitudinally curved with two substantially flat zones between the internal and external ends of the drive member, in the absence of application against the shell, the endless belt part of the track that comes opposite the autonomous vehicle shell is substantially flat in the perpendicular direction, the endless belt part of the track that comes opposite the autonomous vehicle shell is substantially concave towards the outside in the perpendicular direction, the track has an external side intended to be applied against the autonomous vehicle shell and the external side is substantially smooth, the track has an external side intended to be applied against the autonomous vehicle shell and the external side of the track comprises indents, the autonomous vehicle shell includes notches into which the indents may be engaged, said at least one motorized movable element of the drive member is a motorized gear wheel and the autonomous vehicle shell includes notches into which the teeth of the gear wheel engage for rack and pinion drive, each drive member includes at least two motorized gear wheels, one at each longitudinal end of the drive member, the drive member is elongated between two ends, an internal end located in the housing of the receiving and storage structure and an external end located outside the receiving and storage structure, the drive member is swivelling between a recovery waiting position and a drive position, in such a way that, in the recovery waiting position, the drive member is inclined with respect to the direction of access, the internal end of the drive member being closer to the direction of access than the external end of the drive member, and that, in the drive position, the drive member is positioned in such a way as to be applied against the shell of the autonomous vehicle in order to drive the latter, in the drive position, the drive member is positioned against and substantially parallel to the autonomous vehicle shell, the swivelling drive member further has a vehicle storage position in which the autonomous vehicle has entered the receiving and storage structure and is stored thereinto, in the vehicle storage position the drive member being inclined with respect to the direction of access, the external end of the drive member being closer to the direction of access than the internal end of the drive member in order to close the access opening on the rear, the position of the swivelling drive member is controlled by a controlled effector, the effector including a disengaging device disengaging the controlled position in case of stress higher than a determined threshold on the drive member, the position of the swivelling drive member is obtained passively, the swivelling drive member being stressed by a resilient element, in particular a spring, in the recovery waiting position in the absence of any other stress, the drive member is further movable in translation perpendicular to the direction of access, the drive member is further movable in translation perpendicularly to the direction of access, under the action of a controlled effector, the drive member, movable in translation perpendicular to the direction of access, is stressed by a resilient element, in particular a spring, to move closer to the direction of access in the absence of any other stress, the controlled effector is a piston, the system incudes shock absorbers of the drive members, the motorized movable element of the drive member is driven by a hydraulic, electric or pneumatic motor, the motor of the motorized movable element of the drive member is protected against overloads, between one and six drive members are arranged in the access opening and, in the case of at least two drive members, said drive members are equiangularly distributed on the perimeter of the access opening, the system includes a single autonomous vehicle drive member that is arranged in the access opening and at least one rolling roll that is arranged in the access opening, at the opposite of the drive member, the system includes a single autonomous vehicle drive member that is arranged in the access opening and a set of rolling rolls that are arranged on the perimeter of the access opening, opposite the drive member, the system includes two autonomous vehicle drive members that are arranged in the access opening opposite to each other and at least one rolling roll that is arranged in the access opening, the system includes three autonomous vehicle drive members that are arranged equiangularly in the access opening, the system includes three autonomous vehicle drive members that are arranged equiangularly in the access opening and at least one rolling roll that is arranged in the access opening, the system includes at least three autonomous vehicle drive members that are arranged equiangularly in the access opening, the system further includes passive rolling rolls on which the autonomous vehicle shell can circulate, the passive rolling rolls are arranged on the access opening, the passive rolling rolls are arranged in the receiving and storage structure, the system further includes at least one internal drive member arranged totally in the receiving and storage structure, several drive members are distributed over the perimeter of the access opening, the system further includes at least one active rolling roll for driving the autonomous vehicle, said at least one active rolling roll being arranged totally in the receiving and storage structure.

BRIEF DESCRIPTION OF THE DRAWINGS

FIG. 1 shows a simplified top view of an autonomous underwater vehicle and of the entrance part of the receiving and storage structure of the system, FIG. 2 shows a rear lateral view of the receiving and storage structure of the system into which the autonomous underwater vehicle is being introduced, FIG. 3 shows a slightly rear lateral view of an aquatic vehicle in which is inserted the receiving and storage structure of the system into which an autonomous underwater vehicle is being introduced, FIG. 4 shows a rear lateral view of an alternative of the receiving and storage structure of the system in which an autonomous underwater torpedo has just arrived at the access opening through which the autonomous vehicle can pass to enter said receiving and storage structure, FIG. 5 shows a rear lateral view of the alternative of the receiving and storage structure of the FIG. 4, in which an autonomous underwater torpedo is being introduced.

DETAILED DESCRIPTION OF AN EXEMPLARY EMBODIMENT

The following description in relation with the appended drawings, given by way of non-limiting examples, will allow a good understanding of what the invention consists of and of how it can be implemented.

The system of the invention that will be described hereinafter comprises drive members with tracks.

In FIG. 1, the front part of an autonomous vehicle 1 is shown on the left and the rear part of the receiving and storage structure 3 that includes the access opening 12 is shown on the right. The autonomous vehicle 1 comprises an external shell and, on the front, a docking device 10 intended to allow an attachment to a docking station located in a housing of a receiving and storage structure 3. In addition to the hooking, connections may be provided, in particular electric and/or data and/or fluidic connections . . . , through the docking device 10. The autonomous vehicle 1 can comprise, on its lower face, at least one wheel allowing the rolling of said autonomous vehicle 1 on one or more potential lower raceway(s) located on the bottom of the housing of the receiving and storage structure 3. The raceways are typically flared slides.

The autonomous vehicle is, in this example, a submersible floating vehicle. In alternative embodiments, this may be an only floating or only underwater autonomous vehicle.

The receiving and storage structure 3 is consisted of a cage and forms a housing elongated in a main direction of access 13 for the internal storage of the autonomous vehicle 1. The autonomous vehicle 1 enters the receiving and storage structure 3 and exits therefrom along the main direction of access 13 by passing through an access opening 12. The receiving and storage structure 3 is configured in such a way that it can be inserted into an aquatic vehicle (FIG. 3), preferably in a removable manner, so that the receiving structure can be changed as a function of the autonomous vehicle type and/or to optimize the operations.

The receiving and storage structure 3 comprises two drive members 4 with tracks 7. Each driving member 4 with a track 7 is arranged laterally, on the perimeter of the access opening 12, the two drive members 4 with tracks 7 facing each other. The tracks have indents at their surface.

The drive member 4 with a track 7 is longitudinally elongated between two ends: an internal end located in the receiving and storage structure 3 and an external end located outside the receiving and storage structure 3. Each drive member 4 with a track 7 is mounted swivelling/pivoting and is biased by a spring 14 acting in such a way that, in the absence of stress as shown in FIG. 1 and that corresponds to a recovery waiting position, the drive member 4 is inclined in such a way that its internal end is closer to the main direction of access 13 than its external end. In the recovery waiting position, the drive members form at the entrance of the access opening 12 a funnel making it possible to guide and centre the autonomous vehicle along the main direction of access 13.

In the absence of other stress than the spring 14, the drive members 4 are inclined in such a way that the separation/distance between their facing internal ends is lower than the width or diameter of the autonomous vehicle in such a way that the passage of the latter through the access opening 12 causes a swivelling of the drive members to drive positions and the firm application of the drive members 4 against the autonomous vehicle shell. In the case of a system with a single drive member 4, in the absence of stress other than the spring 14, the drive member 4 is inclined in such a way that the separation/distance between its internal end and the perimeter of the access opening 12 facing this internal end is lower than the width or diameter of the autonomous vehicle in such a way that the passage of the latter through the access opening 12 causes a swivelling of the drive member and the firm application thereof against the autonomous vehicle shell.

In this example, the swivelling/pivoting is passive in that this is the autonomous vehicle that causes a swivelling of the drive member by counteracting the effect of the spring 14, which enables the firm application of the drive member against the autonomous vehicle to ensure an efficient drive contact with the track and the autonomous vehicle shell. In an alternative embodiment, a controlled effector can allow an active swivelling of the drive member but, preferably, a spring is also implemented to stress/bias a little the drive member in such a way that its internal end is closer to the main direction of access 13 than its external end in the absence of stress other than that of the spring, which further ensures a security against shocks. The effector can further or as an alternative comprise a security for its temporary retraction in case of excessive shock.

Each drive member 4 with a track 7 has an elongated frame on which is wound an endless belt forming the track 7. The track 7 circulates on wheels 9. Preferably, the wheels 9 are mounted on springs or shock absorbers in order to be able to best fit the autonomous vehicle shell. A motor 8, preferably pneumatic, is installed on the frame of the drive member 4. The advantage of a pneumatic motor is that it is protected against overloads: if a too great resistance is opposed to the track movement, the motor does not risk being damaged.

In FIG. 2, the autonomous vehicle 1 has begun to be driven into the receiving and storage structure 3 by the two drive members 4 with tracks 7. The two lateral, facing, drive members 4 with tracks 7, the distance between the two internal ends of which, in the absence of stress (other than their springs), is lower than the width of the autonomous vehicle, have now swivelled to the drive position and are firmly applied against the lateral parts of the shell of the autonomous vehicle 1. The tracks 7 have been set in motion by the motors 8 and the autonomous vehicle is driven inside the housing of the receiving and storage structure 3.

More generally, the track driving motors 8 may be pneumatic, hydraulic or electric. Preferably, the mechanical transmissions between the motors and the tracks permit a sliding beyond a certain mechanical effort, either through a sliding clutch, or thanks to the motor design itself allowing it to be immobilized without being damaged, as this is the case of certain pneumatic motors.

Detection means allow detecting the presence of an autonomous vehicle to be introduced into the receiving and storage structure 3 and also determining when said autonomous vehicle has fully entered the housing, in order to stop the motors 8 of the tracks 7. Other detection means may be implemented such as, for example, motor overload and/or track jamming detectors. The operation of the system for the recovery and for the exit/release of the autonomous vehicle is controlled by an automaton including computer control and command means liable to also receive remote orders from an operator.

The two drive members 4 with tracks 7 being lateral and opposite to each other on the perimeter of the access opening 12, a certain transverse centring of the autonomous vehicle along the main direction of access 13 is obtained.

Additional autonomous vehicle centring means are implemented, including upper and lower slides 11 for a vertical centring. Lateral slides may be provided. In addition to the potential lower raceways, one/several upper raceways may be arranged on the top of the housing of the receiving and storage structure 3 for the circulation of wheels arranged at the upper surface of the autonomous vehicle 1.

As an alternative or a complement, rolls on the receiving and storage structure 3 allow the autonomous vehicle shell to circulate thereon.

In addition to passive rolls, the receiving and storage structure 3 may also include motorized rolls to help in driving the autonomous vehicle further ahead of the drive members 4 with tracks 7 and, possibly, to continue driving the autonomous vehicle up to its storage position if the latter is such that the drive members 4 with tracks 7 are no longer applied against the autonomous vehicle shell.

In FIG. 3, the receiving and storage structure 3 has been inserted in an aquatic vehicle 5, which is herein a floating vehicle. The autonomous vehicle 1 is stored in the receiving and storage structure 3 and it is hence possible to recover it on a ship by hoisting the aquatic vehicle on the ship and, conversely, to launch it to water by launching the aquatic vehicle 5 to water with the autonomous vehicle in the receiving and storage structure 3.

The floating aquatic vehicle may be towed and passive or be motorized and possibly remote-controlled or wire-guided. The aquatic vehicle may include a crew or be unmanned and autonomous. In alternative embodiments, the aquatic vehicle may be submersible or underwater.

In FIG. 6, the autonomous vehicle 6 is here torpedo-shaped and is an autonomous underwater vehicle. A receiving and storage structure 3 adapted to the torpedo shape is implemented and it includes four drive members 4 with tracks 7 equiangularly distributed on the perimeter of the access opening 12, that is to say at 90° with respect to each other. As hereinabove, the distance between the internal ends of the drive members 4 in the absence of stress (other than their springs) is lower than the diameter of the autonomous vehicle and due to the fact that the recovered autonomous vehicle has begun to be driven into the housing, the drive members have swivelled to the drive position and the tracks 7 are applied against the shell of the autonomous vehicle 6, ensuring both the driving thereof and a certain centring of the latter. It is understood that, for the driving, the motors 8 have been activated for driving the tracks 7 that themselves drive the autonomous vehicle 6.

In FIG. 5, the autonomous vehicle 6 continues to enter the housing of the receiving and storage structure 3, driven by the tracks 7.

The system operation has been presented hereinabove for a recovery operation, but it is understood that it may operate for releasing the autonomous vehicle and, for that purpose, means are provided to rotate the tracks in the opposite direction to the previous one, idem for the potential motorized rolls of the receiving and storage structure 3.

Drive members with tracks have been shown but, in alternative embodiments, it is contemplated to replace the tracks by rack systems, motorized gear wheels being arranged on the surface of the drive members and being capable of engaging the notches at the surface of the autonomous vehicle shell.

In a particular embodiment, an actuator may be provided to position the drive members in a vehicle storage position enabling the receiving structure housing to be closed on the rear once the autonomous vehicle introduced and stored inside said housing.

The invention claimed is:

1. A system for recovering, in a receiving and storage structure (3), an autonomous vehicle (1, 6) in an aquatic environment, the autonomous vehicle (1, 6) having an external shell, the receiving and storage structure (3) comprising an access opening (12) through which the autonomous vehicle passes to enter a housing of said receiving and storage structure (3) or to exit therefrom along a main direction of access (13) to the receiving and storage structure (3), wherein between two and six drive members (4) for driving the autonomous vehicle (1, 6) are arranged in the access opening (12), each drive member (4) comprising at least one motorized movable drive element (7), which comes against the shell of the autonomous vehicle (1, 6) and which enables the autonomous vehicle (1, 6) to be driven into or out of the receiving and storage structure (3), said at least one motorized movable element of each drive member (4) being a track (7) consisting of an endless belt extending between an internal end and an external end of each drive member (4) and configured to be set in motion, wherein for each drive member the internal end is located in the housing of the receiving and storage structure (3) and the external end is located outside the receiving and storage structure (3), wherein each drive member (4) is swivelling between a recovery waiting position and a drive position, the recovery waiting position of each drive member (4) being obtained passively, each drive member (4) being urged by a resilient element (14) toward the recovery waiting position in the absence of any other stress:

in the recovery waiting position, each drive member (4) is inclined with respect to the direction of access (13), the internal end of each drive member (4) being closer to the direction of access (13) than the external end of each drive member (4), and in the absence of applied stress other than the resilient element (14), the drive members (4) are then inclined in such a way that the separation/distance between their facing internal ends is lower than the width or diameter of the autonomous vehicle, in the drive position, each drive member (4) is positioned in such a way as to be applied against the shell of the autonomous vehicle (1, 6) in order to drive the autonomous vehicle, wherein each drive member further has a vehicle storage position in which the autonomous vehicle has entered the receiving and storage structure and is stored thereinto, in the vehicle storage position each drive member being inclined with respect to the direction of access, the external end of each drive member being closer to the direction of access than the internal end of each drive member in order to close the access opening on the rear, wherein the endless belt part of the track that comes opposite the autonomous vehicle shell is longitudinally curved between the internal end and the external end of each drive member, in the absence of an application against the shell of the autonomous vehicle (1, 6), and wherein the endless belt part of the track that comes opposite the autonomous vehicle shell between the internal end and the external end of each drive member rests on a frame of each drive member through wheels mounted on springs or shock absorbers.

2. The system according to claim 1, wherein the track (7) has an external side intended to be applied against the shell of the autonomous vehicle (1, 6) and the external side of the track (7) includes indents.

3. The system according to claim 2, wherein the shell of the autonomous vehicle (1, 6) comprises notches into which the indents may be engaged.

4. The system according to claim 3, wherein each drive member (4) is moreover movable in translation perpendicular to the direction of access (13).

5. The system according to claim 3, wherein the motorized movable element (7) of each drive member (4) is driven by a hydraulic, electric or pneumatic motor (8).

6. The system according to claim 3, wherein several drive members (4) are equiangularly distributed on the perimeter of the access opening (12).

7. The system according to claim 3, wherein the system further includes passive rolling rolls on which the autonomous vehicle shell can circulate.

8. The system according to claim 3, wherein each drive member is further rendered swivelable with an actuator toward the vehicle storage position once the autonomous vehicle is introduced and stored inside said housing.

9. The system according to claim 1, wherein each drive member (4) is moreover movable in translation perpendicular to the direction of access (13).

10. The system according to claim 9, wherein the motorized movable element (7) of each drive member (4) is driven by a hydraulic, electric or pneumatic motor (8).

11. The system according to claim 9, wherein several drive members (4) are equiangularly distributed on the perimeter of the access opening (12).

12. The system according to claim 9, wherein each drive member is further rendered swivelable with an actuator toward the vehicle storage position once the autonomous vehicle is introduced and stored inside said housing.

13. The system according to claim 1, wherein the motorized movable element (7) of each drive member (4) is driven by a hydraulic, electric or pneumatic motor (8).

14. The system according to claim 13, wherein the motor of the motorized movable element of each drive member is protected against overloads.

15. The system according to claim 1, wherein several drive members (4) are equiangularly distributed on the perimeter of the access opening (12).

16. The system according to claim 1, wherein the system includes shock absorbers in the drive members.

17. The system according to claim 1, wherein the system further includes passive rolling rolls on which the autonomous vehicle shell can circulate.

18. The system according to claim 1, wherein each drive member is further rendered swivelable with an actuator toward the vehicle storage position once the autonomous vehicle is introduced and stored inside said housing.

19. The system according to claim 18, wherein each drive member (4) is moreover movable in translation perpendicular to the direction of access (13).

* * * * *